US011753860B2

(12) United States Patent
Weston et al.

(10) Patent No.: US 11,753,860 B2
(45) Date of Patent: Sep. 12, 2023

(54) VEHICLE HAVING POWERED DOOR CONTROL WITH OBJECT DETECTION AND CLASSIFICATION

(71) Applicant: Ford Global Technologies, LLC, Dearborn, MI (US)

(72) Inventors: Keith Weston, Canton, MI (US); Andrew Denis Lewandowski, Sterling Heights, MI (US); Brendan Diamond, Grosse Pointe, MI (US); Michael Alan McNees, Flat Rock, MI (US); Jordan Barrett, Milford, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 106 days.

(21) Appl. No.: 17/411,323

(22) Filed: Aug. 25, 2021

(65) Prior Publication Data

US 2023/0065657 A1 Mar. 2, 2023

(51) Int. Cl.
*E05F 15/00* (2015.01)
*E05F 15/73* (2015.01)

(52) U.S. Cl.
CPC ..... *E05F 15/73* (2015.01); *E05F 2015/767* (2015.01); *E05Y 2400/354* (2013.01); *E05Y 2400/36* (2013.01); *E05Y 2400/54* (2013.01); *E05Y 2900/546* (2013.01)

(58) Field of Classification Search
CPC . E05F 15/71; E05F 15/79; E05F 15/00; E05F 15/73; E05F 2015/767; E05Y 2400/40; E05Y 2400/44; E05Y 2900/531; E05Y 2400/456; E05Y 2900/546; E05Y 2400/36; E05Y 2201/41; E05Y 2400/354; E05Y 2400/54
See application file for complete search history.

(56) References Cited

U.S. PATENT DOCUMENTS

| | | | | |
|---|---|---|---|---|
| RE38,400 | E * | 1/2004 | Kowall | E05F 15/41 318/266 |
| 6,676,186 | B2 * | 1/2004 | Greif | E05F 15/43 49/27 |
| 6,719,356 | B2 * | 4/2004 | Cleland | E05F 1/1091 49/339 |
| 7,403,102 | B2 | 7/2008 | Fukuda et al. | |
| 7,761,209 | B2 | 7/2010 | Morris et al. | |
| 10,613,219 | B1 * | 4/2020 | DeCia | E05F 15/73 |
| 2014/0041301 | A1 * | 2/2014 | Oakley | E05B 81/74 49/506 |

(Continued)

FOREIGN PATENT DOCUMENTS

| | | | |
|---|---|---|---|
| DE | 102017125123 | A1 | 5/2019 |
| FR | 3078035 | A1 | 8/2019 |

*Primary Examiner* — Chi Q Nguyen
(74) *Attorney, Agent, or Firm* — Frank Lollo; Price Heneveld LLP

(57) ABSTRACT

A vehicle having a powered tailgate is provided. The vehicle includes a body, a powered tailgate pivotally connected to the body, an actuator operatively coupled to the tailgate to move the tailgate between open and closed positions, and sensors configured to sense an object in a swing path of the tailgate. The vehicle also includes a controller for processing signals output from the sensor and identifying and classifying the object, and controlling the actuator to move the tailgate between the open and closed positions based on the classified object.

20 Claims, 7 Drawing Sheets

(56) References Cited

U.S. PATENT DOCUMENTS

| | | | | |
|---|---|---|---|---|
| 2017/0234054 | A1* | 8/2017 | Kumar | E05F 15/73 49/324 |
| 2019/0145151 | A1* | 5/2019 | Iikawa | H02P 23/20 49/28 |
| 2019/0360255 | A1* | 11/2019 | Ozaki | B61D 19/026 |
| 2020/0002995 | A1* | 1/2020 | Salter | E05F 15/70 |
| 2020/0141171 | A1* | 5/2020 | Ghannam | B60Q 1/50 |
| 2021/0171127 | A1* | 6/2021 | Harris | B62D 33/0273 |
| 2021/0293074 | A1* | 9/2021 | Morosawa | E05F 15/73 |

* cited by examiner

VEHICLE HAVING POWERED DOOR CONTROL WITH OBJECT DETECTION AND CLASSIFICATION

FIELD OF THE DISCLOSURE

The present disclosure generally relates to control of vehicle powered doors, and more particularly relates to a system and method of controlling a vehicle door, such as a tailgate, to reduce the likelihood of collision with an object.

BACKGROUND OF THE DISCLOSURE

Motor vehicles are commonly equipped with various closure doors to allow ingress and egress of the vehicle passenger compartment and the bed of a pickup truck. A pickup truck typically includes a door in the form of a tailgate at the rear end of the vehicle bed that pivots between a closed vertical position and an open horizontal position. The tailgate may be powered with an electric motor to move the tailgate between the open and closed positions. It may be desirable to provide for the control of the powered tailgate in a manner that reduces the likelihood of interference with an object.

SUMMARY OF THE DISCLOSURE

According to a first aspect of the present disclosure, a vehicle is provided that includes a body, a powered door pivotally connected to the body, and an actuator operatively coupled to the door to move the powered door between open and closed positions. The vehicle also includes a sensor configured to sense one or more objects in a swing path of the powered door, and a controller for processing signals output from the sensor and identifying the object and classifying the object, the controller controlling the actuator to move the powered door between the open and closed positions based on the classified object.

Embodiments of the first aspect of the disclosure can include any one or a combination of the following features:

- the powered door comprises a tailgate;
- the tailgate pivots about a horizontal axis between a substantially vertical closed position and a substantially horizontal open position;
- the controller further ranks the object and actuates the actuator based on the ranking;
- the sensor comprises an imaging device for capturing images of an area including the swing path of the powered door;
- the processor processes the images captured with the imaging device and compares the images of the object to known objects and classifies the detected object based on the comparison;
- the sensor comprises a plurality of sensors further comprising one or more of an ultrasonic sensor, radar and Lidar;
- the controller controls the actuator to limit movement of the powered door from moving to the open positon when a first classified object is detected and allows the powered door to move to the open position when a second classified object is detected;
- the controller controls speed of the actuation of the powered door based on the classified type of object; and
- the actuator comprises an electric motor.

According to a second aspect of the present disclosure, a vehicle is provided that includes a body, a powered tailgate pivotally connected to the body, and an actuator operatively coupled to the powered tailgate to move the powered tailgate between open and closed positions. The vehicle also includes a sensor arrangement configured to sense one or more objects in a swing path of the powered tailgate, and a controller for processing signals output from the sensor arrangement and identifying the object and classifying the object, the controller controlling the actuator to move the powered tailgate between the open and closed positions based on the classified object.

Embodiments of the second aspect of the disclosure can include any one or a combination of the following features:

- the controller further ranks the object and actuates the actuator based on the ranking;
- the powered tailgate pivots about a horizontal axis between a substantially vertical closed position and a substantially horizontal open position;
- the sensor arrangement comprises an imaging device for capturing images of an area including the swing path of the powered tailgate;
- the processor processes the images captured with the imaging device and compares the images of the object to known objects and classifies the detected object based on the comparison;
- the sensor further comprises one or more of an ultrasonic sensor, radar and Lidar;
- the controller controls the actuator to limit movement of the powered tailgate from moving to the open positon when a first classified object is detected and allows the powered tailgate to move to the open position when a second classified object is detected;
- the controller controls speed of the actuation of the powered tailgate based on the classified type of object.

According to a third aspect of the present disclosure, a method of controlling a powered tailgate on a vehicle is provided. The method includes the steps of sensing an object in a swing path of the powered tailgate, processing signals output from the sensor and identifying the object and classifying the object, and controlling an actuator to move the tailgate between the open and closed positions based on the classified object.

An embodiment of the third aspect of the disclosure can include the following feature:

- the controller further ranks the object and actuates the actuator based on the ranking.

These and other aspects, objects, and features of the present invention will be understood and appreciated by those skilled in the art upon studying the following specification, claims, and appended drawings.

DETAILED DESCRIPTION OF THE PREFERRED EMBODIMENTS

As required, detailed embodiments of the present disclosure are disclosed herein; however, it is to be understood that the disclosed embodiments are merely exemplary of the invention that may be embodied in various and alternative forms. The figures are not necessarily to a detailed design; some schematics may be exaggerated or minimized to show function overview. Therefore, specific structural and functional details disclosed herein are not to be interpreted as limiting, but merely as a representative basis for teaching one skilled in the art to variously employ the present invention.

Figure 1:
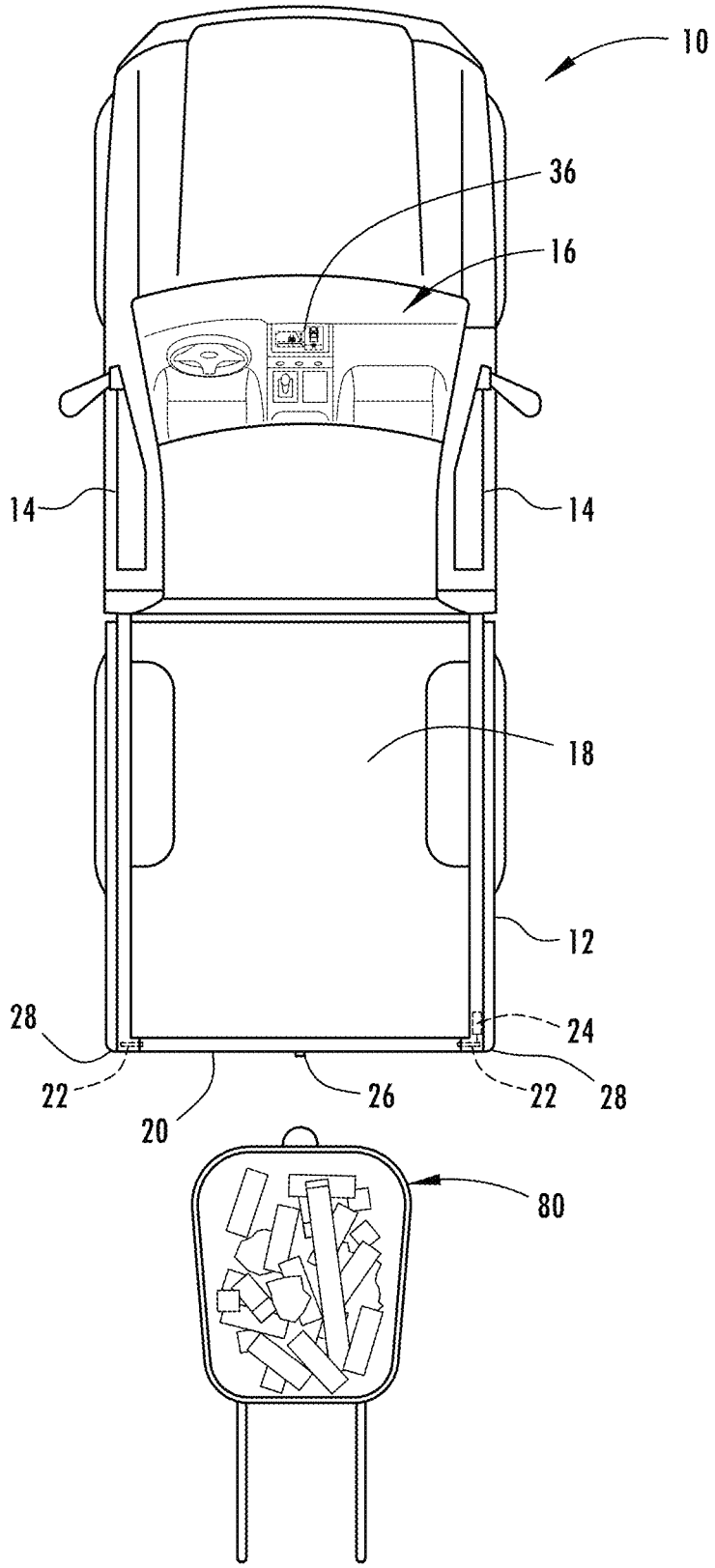
FIG. 1 is a top schematic view of a motor vehicle equipped with a powered tailgate and controls for reducing the likelihood of interference of the tailgate with an object, according to one example.

For purposes of description herein, the terms "upper," "lower," "right," "left," "rear," "front," "vertical," "horizontal," and derivatives thereof shall relate to the concepts as oriented in FIG. 1. However, it is to be understood that the concepts may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The present illustrated embodiments reside primarily in combinations of method steps and apparatus components related to a vehicle having a powered tailgate with object classification and interference avoidance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

As used herein, the term "and/or," when used in a list of two or more items, means that any one of the listed items can be employed by itself, or any combination of two or more of the listed items, can be employed. For example, if a composition is described as containing components A, B, and/or C, the composition can contain A alone; B alone; C alone; A and B in combination; A and C in combination; B and C in combination; or A, B, and C in combination.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the end-points of each of the ranges are significant both in relation to the other end-point, and independently of the other end-point.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

Referring to FIG. 1, a wheeled automotive or motor vehicle 10 is generally illustrated having a cabin interior 16 defined by a vehicle body 12 and configured with passenger seating for transporting passengers in the vehicle 10. The cabin interior 16 is generally defined by the vehicle body 12 and may include various features and trim components within the cabin interior 16. The cabin interior 16 may include an arrangement of passenger seats and a steering wheel to enable the driver to steer vehicle road wheels. Additionally, one or more human machine interfaces (HMI), such as a touchscreen display 36, audio speakers, microphone, etc., may be provided on the vehicle 10 to communicate with the driver and one or more passengers in the vehicle 10.

The vehicle 10 is equipped with side passenger doors 14 which may be powered doors located on opposite lateral sides of the vehicle 10 proximate to the vehicle seating. Each of the passenger doors 14 may close a space of the cabin interior 16 in the closed door position and allow access to the cabin interior 16 in an open door position. The passenger doors 14 may be powered doors, each having an actuator, such as a motor, for moving the corresponding door between the closed and open door positions. The powered actuators may move the powered doors 14 between the closed and open door positions in response to a user input, such as an input entered on a key fob, a smartphone or other electronic device. Additionally, the powered doors may be opened and closed by the actuators in response to detecting movement or position of a driver approaching or departing the vehicle 10.

The vehicle 10, shown as a pickup truck, has a bed 18 with a rear wall defined by the tailgate 20 in the closed vertical position as shown in FIG. 1. The vehicle 10 is equipped with a horizontal pivoting door in the form of the tailgate 20 at the rear end of the vehicle 10 that forms the rear wall of the bed 18 in the closed position. The tailgate 20 includes a panel having a pair of hinges 22 on opposite lower ends that allow the tailgate 20 to pivot about the horizontal axis between a vertical closed position defining the rear end of the bed 18 and a horizontal open position exposing the rear end of the bed 18. The tailgate 20 shown and described herein is a powered tailgate having an actuator for actuating the tailgate 20 between the open and closed positions. The actuator 24 may be operatively coupled to at least one of the hinges 22 to apply force to rotate the tailgate 20 between the open and closed positions. The actuator 24 may rotate the tailgate 20 between the open and closed positions at a predetermined speed or may vary the speed of rotation of the tailgate 20.

The vehicle 10 is equipped with a plurality of sensors that are located on the vehicle 10 for sensing one or more objects such as obstacles outside of the vehicle 10 and within a space surrounding the vehicle 10 and generating sensed signals indicative of the sensed objects. The plurality of sensors may include one or more imaging devices, such as a rear facing camera 26, which is shown located on an upper central portion of the tailgate 20. The camera 26 may acquire images of the space rearward of the vehicle 10 including the space within the swing path of the tailgate 20. The acquired images may be processed by image processing with a controller to identify the objects, characteristics of the objects and the position and movement of the objects relative to the vehicle 10. In addition, a plurality of ultrasonic sensors 30 are shown located in the taillight housings 28 at the rear corners of the vehicle 10 for sensing objects located in the space outside of the vehicle and within the space rearward of the vehicle 10. Further, radar sensors 32 are shown in the rear taillight housings 28 at rear corners of the vehicle 10 for sensing objects located outside of the vehicle and within the space rearward the vehicle 10. The radar sensors 32 transmit radio waves and process their reflections from each object to determine distance to the object and location of the object. As such, the radar and ultrasonic sensors 30 and 32 may detect the location, size and relative distance from the vehicle 10 to each detected object within the space, particularly the space within the swing path of the tailgate 20. It should be appreciated that other sensors such as Lidar 34 may be employed by the vehicle 10 to sense objects relative to the vehicle 10 and generate sensed signals that may be used to identify each object and the distance and location of the sensed object relative to the vehicle 10 for use in assisting with the operation of the powered tailgate 20.

Figure 2A:
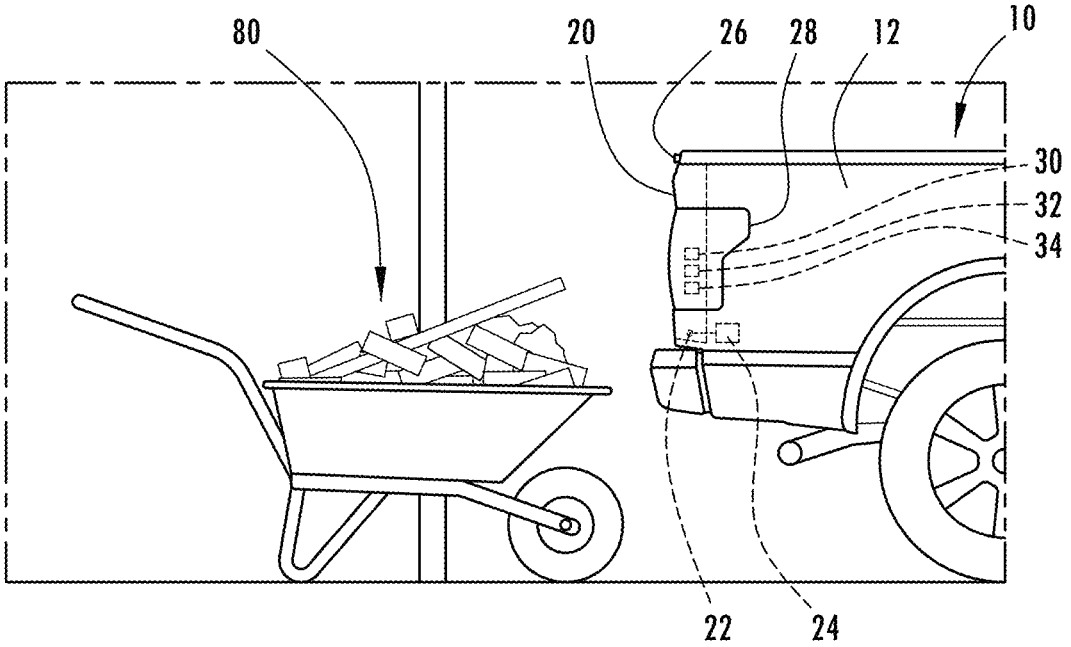
FIG. 2A is a side view of a rear portion of the motor vehicle with the tailgate in the closed position and proximate to a first object.
Figure 2B:
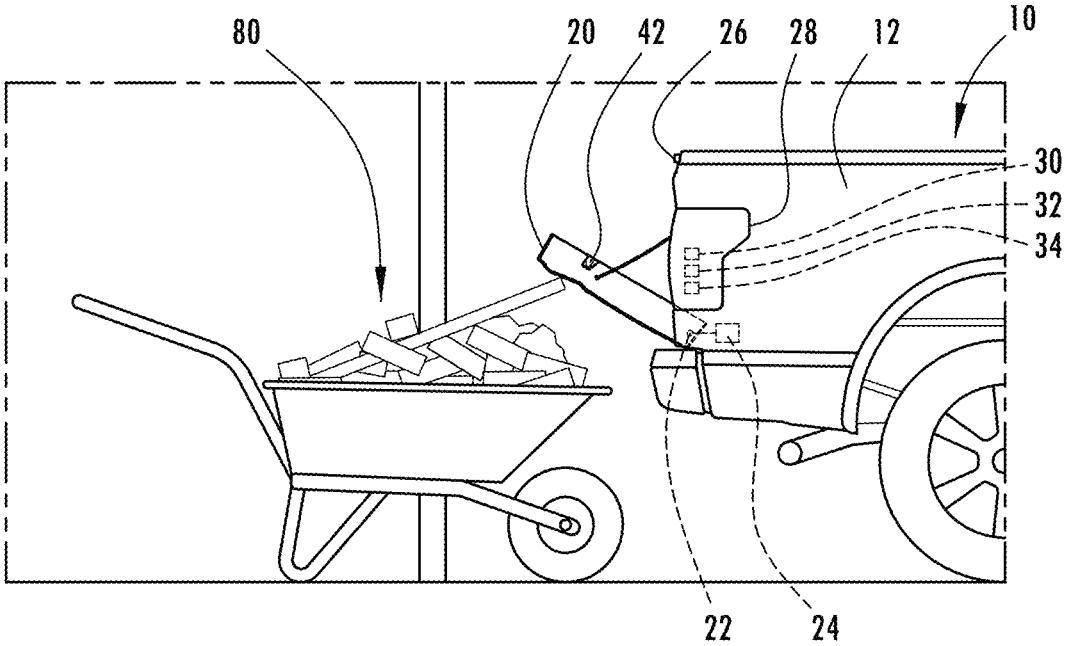
FIG. 2B is a side view of the rear portion of the motor vehicle with the tailgate in a partially open position in contact with the first object.

In the example shown in FIGS. 1-2B, a first object 80 is shown located rearward of the vehicle 10 within a space proximate to the vehicle 10 where it may interfere with the tailgate 20 when the tailgate 20 moves through a swing path from the closed position to the open position. The object 80 shown in this example is a solid inanimate object in the form of a wheelbarrow having rigid items stowed thereon such as wood boards and bricks, for example. A user of the vehicle 10 may initiate a command or actuate a switch to deploy the actuator 24 to move the tailgate 20 from the closed position shown in FIG. 2A to a partially open position shown in FIG. 2B. In doing so, the object 80 may interfere with the movement the tailgate 20 since the object 80 is located within the swing path of the tailgate 20. The controller may identify the object 80, classify the object 80 and rank the object 80 and may control the actuator 24 to control movement of the tailgate 20 based on the classified and ranked object. It should be appreciated that the actuator 24 may hold the tailgate 20 in the closed position. In one embodiment, the tailgate 20 has a latch 42 that may hold the tailgate 20 in the closed position.

Figure 3A:
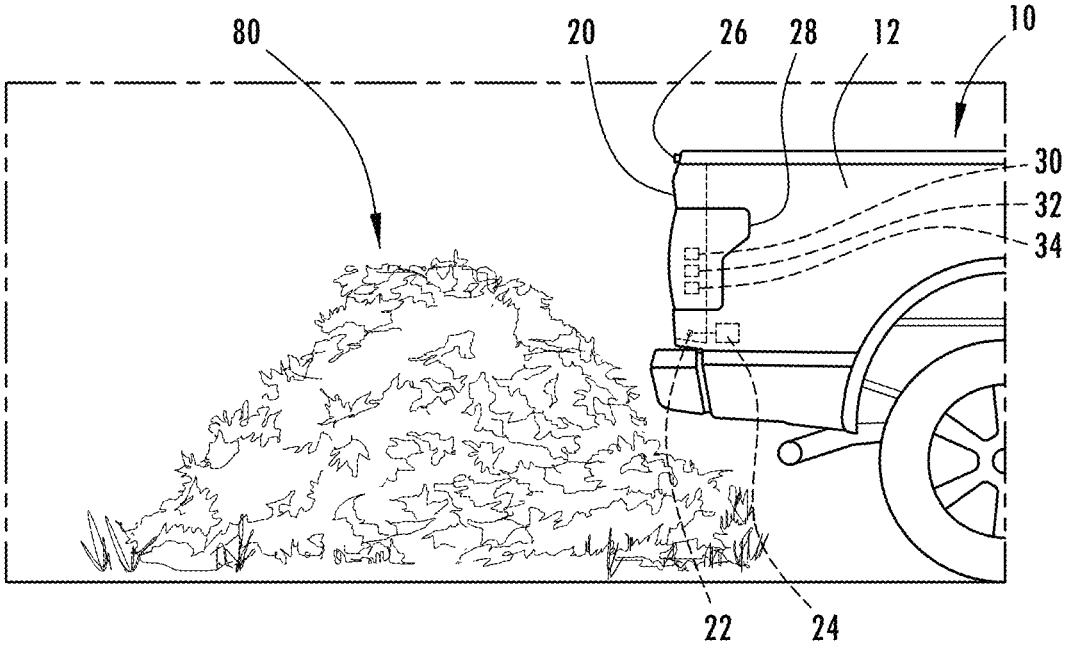
FIG. 3A is a side view of the rear portion of the vehicle with the tailgate in the closed position and proximate to a second object, according to another example.
Figure 3B:
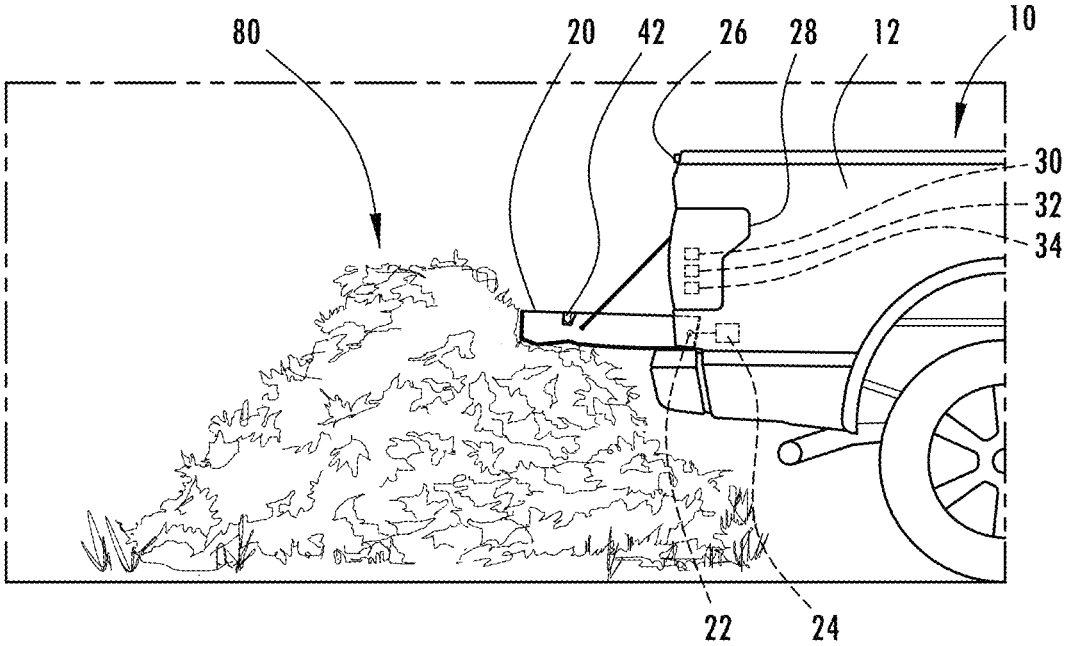
FIG. 3B is a side view of the rear portion of the vehicle with the tailgate in the open position and proximate to the second object.

Referring to FIGS. 3A and 3B, a second object 80 which is a soft inanimate object in the form of a pile of leaves is shown located rearward of the vehicle 10 proximate to and within the swing path of the tailgate 20, according to another example. In this example, the pile of leaves are generally soft and compliant such that the pile of leaves does not generally pose a risk of damage to the tailgate 20 and the tailgate 20 does not pose a risk of damage to the pile of leaves when the tailgate is actuated from the closed position shown in FIG. 3A to the fully open position shown in FIG. 3B.

Figure 4:
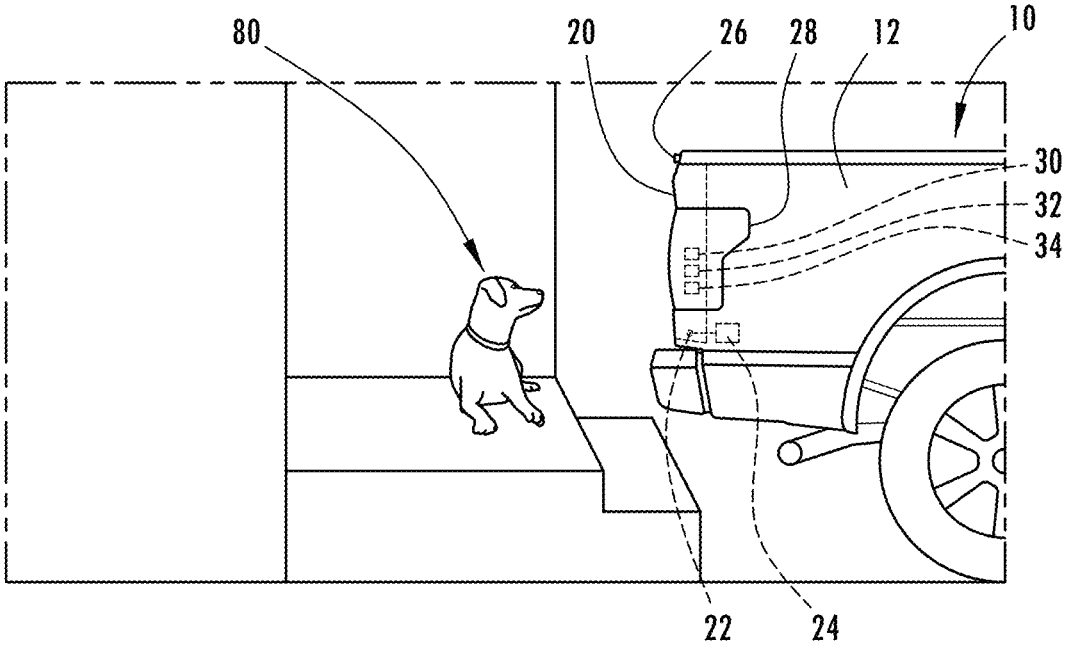
FIG. 4 is a side view of the rear portion of the vehicle with the tailgate in the closed position and proximate to a third object, according to a further example.

Referring to FIG. 4, an animate third object 80, such as a pet, e.g., a dog, is shown in the space rearward of the vehicle 10 within the swing path of the tailgate 20. In this example, the tailgate 20 if deployed to move from the closed position to the fully open position may contact the object 80. The camera 26 and other sensors 30, 32 and 34 generate sensed signals that are processed to detect the object 80 in the swing path of the tailgate 20, recognize and classify the object 80 as an animate object, rank the object, and control movement of the tailgate 20 when an animate object 80 is located within the swing path of the tailgate 20.

Figure 5:
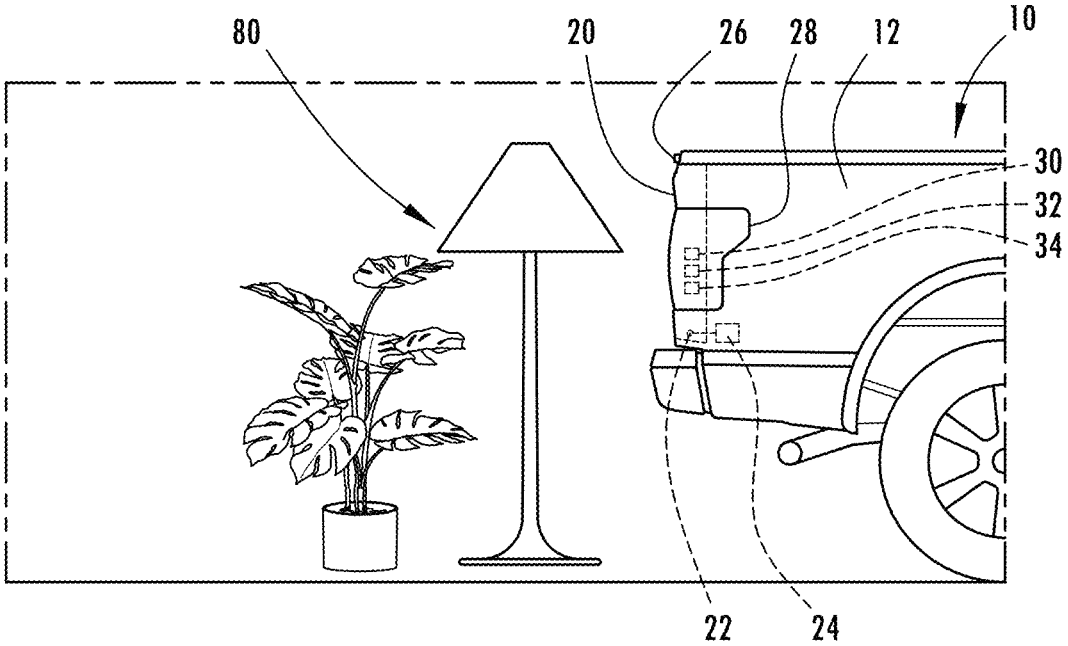
FIG. 5 is a side view of the rear portion of the vehicle with the tailgate in the closed position and proximate to a fourth object, according to yet a further example.

Referring to FIG. 5, a fragile and valuable fourth object 80, in the form of a lamp, is shown located within the space within the swing path of the tailgate 20, according to a further example. In this example, the object 80 may be susceptible to damage due to movement of the tailgate 20 from the closed position to the fully open position. In addition, the fragile object 80 may further damage the tailgate 20 when the tailgate moves from the closed position to the fully open position. The camera 26 and other sensors 30, 32, and 34 generate sensed signals that are processed such that the object 80 is determined and classified and ranked, and the classification and ranking of the object 80 is used to control the movement of the tailgate 20 between the closed and open positions.

Figure 6:
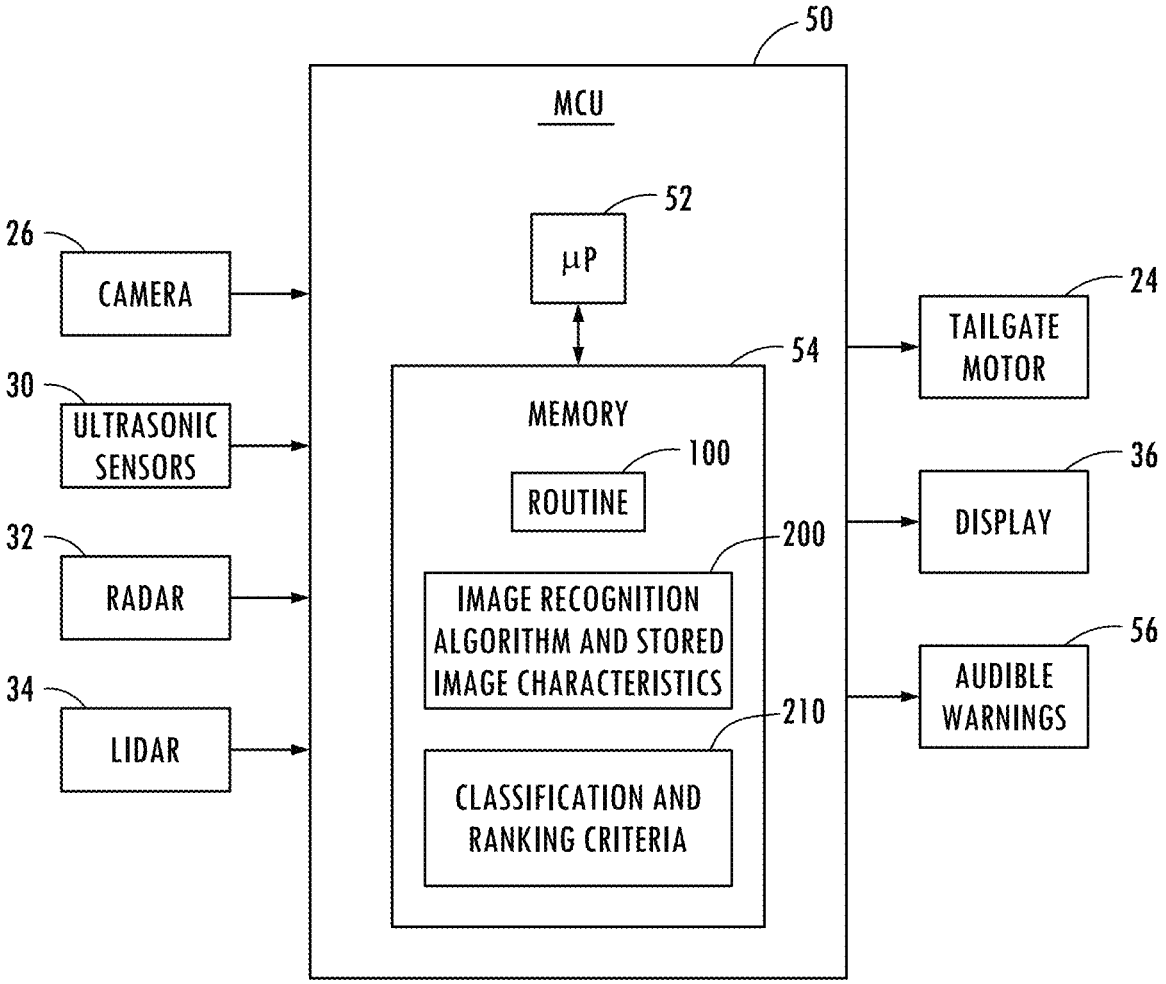
FIG. 6 is a block diagram of the vehicle controller configured to detect and classify an object and control the powered tailgate, according to one embodiment; and FIG. 7A

Referring to FIG. 6, a vehicle controller 50 is shown configured as a microcontrol unit (MCU) for processing the various signals generated by the sensors and controlling the movement of the tailgate 20, according to one embodiment. The vehicle controller 50 includes control circuitry, such as a microprocessor 52 and memory 54. It should be appreciated that the vehicle controller 50 may be made up of analog and/or digital control circuitry. Stored in memory 54 are one or more routines 100 image recognition algorithm and stored image characteristics 200 and classification and ranking criteria 210. The vehicle controller 50 via the processor receives various input signals from the plurality of sensors including the camera 26, ultrasonic sensors 30, radar 32, and Lidar 34, and processes the sensor signals in accordance with routine 100, along with image recognition algorithm and store image characteristics 200 and classification and ranking criteria 210 which is executed by the microprocessor 52. In doing so, the vehicle controller 50 classifies and ranks the sensed objects based on various characteristics and determines the appropriate actuation of the tailgate motor 24 to move or stop movement of the tailgate 20 based on the object classification and ranking. For example, the controller 50 may classify a detected object as an animate or inanimate object, a dynamic or static object, an object having a certain sharpness, an object having a certain phase, such as solid, gas or liquid, an object having a natural reoccurring phenomenon, such rain, snow or fog, an object having a structural integrity, such as soft or rigid object, an object having a value such as a high monetary value. The classifications and rankings may be indicative of whether an object is a living entity, such as a person, a dog, a cat, etc. The classification/ranking may also be indicative of whether an object may be damaged by a tailgate or whether the object is of value and susceptible of being damaged by the tailgate. Further, the classification/ranking may be used to determine the tailgate may be damaged by the object. For example, if the object is a sharp solid object, the ranking may be such that the tailgate 20 may be determined to be more susceptible to damage such that the tailgate 20 may reduce the likelihood of contacting the object. Depending on the classification and ranking of the detected objects, the movement of the powered tailgate 20 is controlled. This may include reducing the likelihood of the tailgate 20 from opening or closing, opening the tailgate 20 at a faster or slower rate to reduce the likelihood of damage to an object or the vehicle tailgate 20, opening the tailgate 20, and if the object is not moved, returning the tailgate 20 to the closed position, opening the tailgate 20 to a predetermined angle, holding the position, and waiting for the object to move out of the way before the tailgate 20 opening is complete, or allowing only part of the tailgate 20 to open.

The controller 50 may provide a warning to a user, such as on the display 36 or an audible warning 56 via an audio device. The warning may instruct or enable the user to move the vehicle 10 or the object to reduce the risk of contact with the object and enable the tailgate 20 to move between the closed and open positions without interference from the object.

Figure 7A:
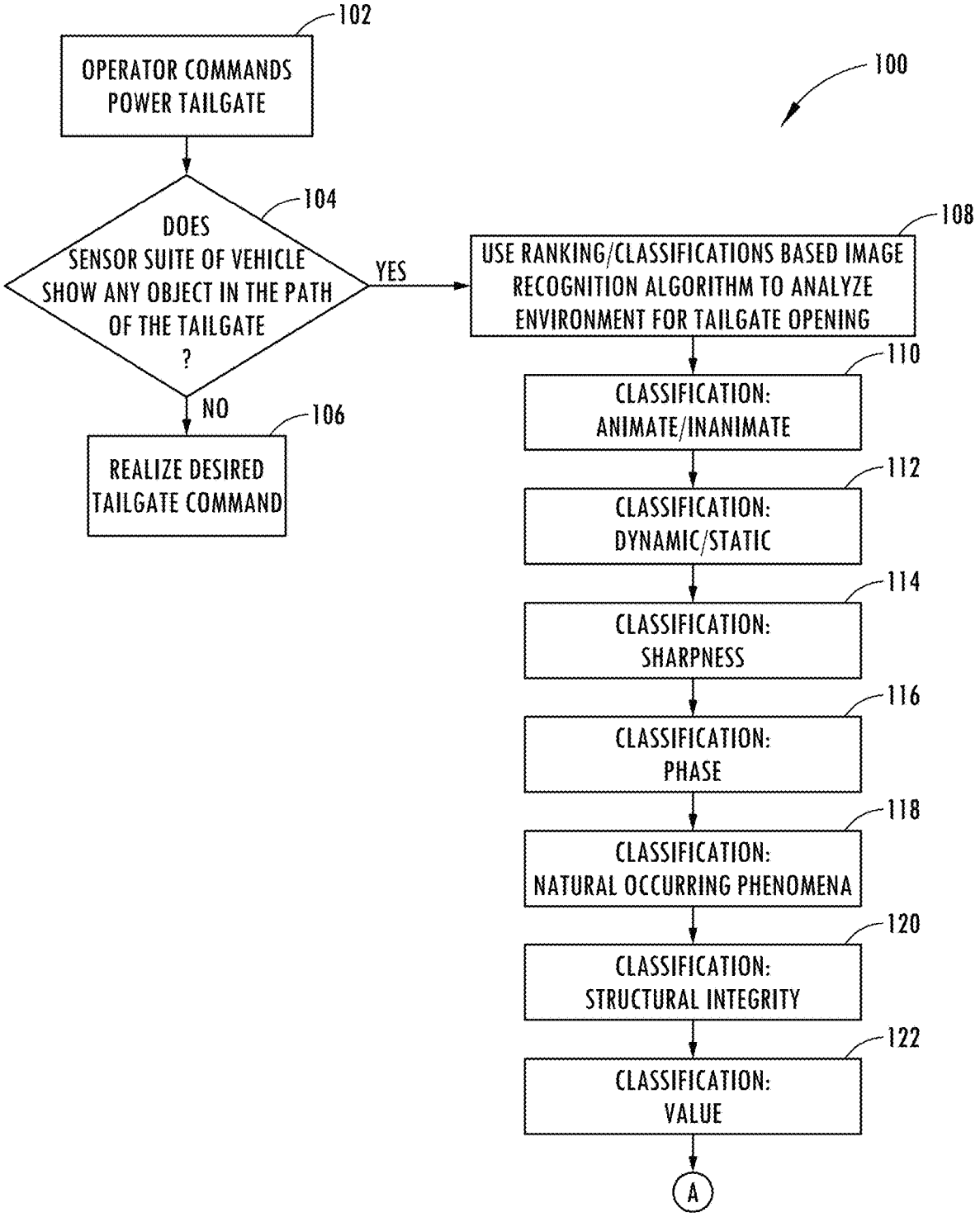
FIG. 7B is a flow diagram illustrating a routine for detecting and classifying objects and controlling the powered tailgate based on the classified object, according to one example.
Figure 7B:
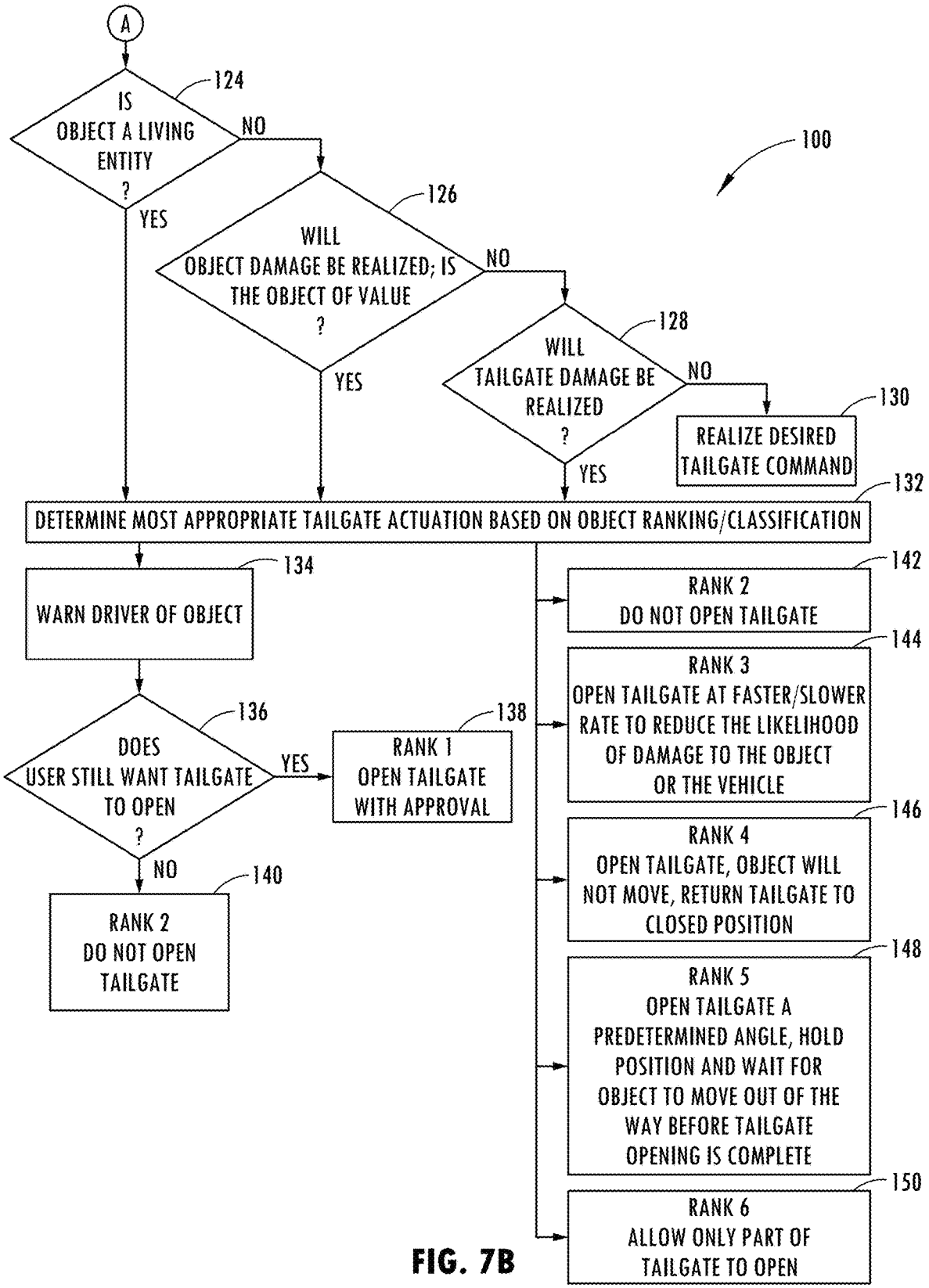

Referring to FIGS. 7A and 7B, the routine 100 for sensing objects in the path of the tailgate, classifying and ranking the objects, and controlling actuation of the powered tailgate is illustrated, according to one example. The routine 100 begins at step 102 when an operator commands movement of the powered tailgate. Next, at decision step 104, routine 100 determines whether the plurality of sensors, including the camera, ultrasonic sensors, radar and Lidar generate signals indicative of the presence of an object in the swing path of the tailgate. If the signals generated by the plurality of sensors does not indicate an object is within the path of the tailgate, routine 100 proceeds to step 106 to perform the desired tailgate command which may be a command to actuate the tailgate to the open or closed position.

If an object is detected in the path of the tailgate, routine 100 proceeds to step 108 to perform the classification and ranking of the object, depending upon one or more sensed characteristics of the object. The ranking/classification may be based on image recognition algorithms and stored image characteristics of known objects to analyze the environment for the tailgate opening. Routine 100 may classify a sensed object as an animate object or an inanimate object in step 110. Routine 100 may classify an object as dynamic or static in step 112. Routine 100 may further classify an object based on its sharpness, such as a corner of a rectangular board or dull such as a leaf in step 114. Routine 100 may further classify an object based on its phase, such as solid, liquid or gas in step 116. Routine 100 may classify an object based on natural occurring phenomenon, such as rain, snow, ice, etc. at step 118. Routine 100 may classify an object based on its structural integrity, such as its rigidity (e.g., rock) or softness (e.g., leaf) at step 120. Further, routine 100 may classify an object based on its value, such as its monetary value, indicative of whether the object is expensive or inexpensive at step 122.

Next, routine 100 proceeds to decision step 124 to determine if the object is an animate object or a living entity, such as a person, an animal, such as a pet (e.g., dog or cat). If the object is determined to be a living entity, routine 100 proceeds to decision step 132 to determine the most appropriate tailgate actuation based on the object ranking/classifications. If the object is not determined to be a living entity, routine 100 proceeds to decision step 126 to determine if the object is susceptible to damage due to movement of the tailgate or if the object is of value and, if so, proceeds to step 132 to determine the most appropriate tailgate actuation based on object ranking/classifications. Otherwise, routine 100 proceeds to decision step 128 to determine if the tailgate is susceptible to being damaged by the object and, if so, proceeds to step 132 to determine the most appropriate tailgate actuation based on object ranking/classifications. Otherwise, routine 100 proceeds to step 130 to realize the desired tailgate command.

At step 132, routine 100 determines the most appropriate tailgate actuation based on object ranking/classifications and then commands actuation of the tailgate via the actuator based on the object ranking/classification. The routine 100 may warn a user (e.g., driver) of the vehicle 10 of the potential interference with an object via an HMI at step 134 and then determine if the user still wants the powered tailgate to move to the open position at decision step 136 and, if so, will command actuation to open the tailgate with approval of the user based on a ranking of rank 1 at step 138. Otherwise, routine 100 will not open or close of the tailgate based on a ranking of rank 2 at step 140. The routine 100 may open the tailgate if the object is determined to have a ranking of rank 2 at step 142. Routine 100, when determining the most appropriate tailgate actuation, may open the tailgate at a faster/slower rate to reduce the likelihood of damage to the object or the vehicle when the object has a certain ranking such as rank 3 at step 144. Routine 100 may open the tailgate, and if the object does not move, return the tailgate to the closed position if the object is ranked at a predetermined ranking of rank 4 at step 144. Routine 100 may open the tailgate and, if the object does not move, return the tailgate to the closed position based on a ranking of rank 4 at step 146. Routine 100 may open the tailgate a predetermined angle, hold the tailgate position, and wait for the object to move out of the way of the tailgate before the tailgate opening is complete, if the object is ranked at a rank 5 at step 148. Routine 100 may allow only part of the tailgate to open if the object is determined to have a ranking of rank 6 at step 150. Accordingly, the type of action initiated by the controller to move the tailgate will depend upon the classification and ranking of the detected object. This allows for different actuations of the tailgate depending upon the type of object sensed within the swing path of the tailgate.

While the powered tailgate 20 of a vehicle 10 is shown and described herein as the powered door that is controlled to move between the open and closed positions, it should be appreciated that one or more other doors may similarly be controlled. For example, the powered door may be a passenger door that is controlled to move between open and closed positions based on the identified classified and ranked object.

Accordingly, a vehicle 10 has a powered door, such as a tailgate 20, that is controlled to move the tailgate 20 between open and closed positions based on sensed, classified and ranked objects 80 is provided. The powered tailgate 20 may advantageously be actuated or reduce the likelihood of moving under different circumstances depending upon the classification and ranking of the sensed objects. This allows for protection of the tailgate 20 and the object 80 and enhanced operation of the tailgate 20.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A vehicle comprising:

a body;

a powered door pivotally connected to the body;

an actuator operatively coupled to the powered door to move the powered door between open and closed positions;

a sensor configured to sense one or more objects in a swing path of the powered door; and a controller processing signals output from the sensor and identifying the object and classifying the object, the controller controlling the actuator to move the powered door between the open and closed positions based on the classified object.

2. The vehicle of claim 1, wherein the powered door comprises a tailgate.

3. The vehicle of claim 2, wherein the tailgate pivots about a horizontal axis between a substantially vertical closed position and a substantially horizontal open position.

4. The vehicle of claim 1, wherein the controller further ranks the object and actuates the actuator based on a ranking.

5. The vehicle of claim 1, wherein the sensor comprises an imaging device for capturing images of an area including the swing path of the powered door.

6. The vehicle of claim 5, wherein the controller processes the images captured with the imaging device and compares the images of the object to known objects and classifies the detected object based on the comparison.

7. The vehicle of claim 5, wherein the sensor comprises a plurality of sensors further comprising one or more of an ultrasonic sensor, radar and Lidar.

8. The vehicle of claim 1, wherein the controller controls the actuator to limit movement of the powered door from moving to the open position based on a first classified object being detected and allows the powered door to move to the open position based on a second classified object being detected.

9. The vehicle of claim 8, wherein the controller controls speed of the actuation of the powered door based on the classified type of object.

10. The vehicle of claim 1, wherein the actuator comprises an electric motor.

11. A vehicle comprising:

a body;

a powered tailgate pivotally connected to the body;

an actuator operatively coupled to the powered tailgate to move the powered tailgate between open and closed positions;

a sensor arrangement configured to sense one or more objects in a swing path of the powered tailgate; and a controller processing signals output from the sensor arrangement and identifying the object and classifying the object, the controller controlling the actuator to move the powered tailgate between the open and closed positions based on the classified object.

12. The vehicle of claim 11, wherein the controller further ranks the object and actuates the actuator based on a ranking.

13. The vehicle of claim 11, wherein the powered tailgate pivots about a horizontal axis between a substantially vertical closed position and a substantially horizontal open position.

14. The vehicle of claim 11, wherein the sensor arrangement comprises an imaging device for capturing images of an area including the swing path of the powered tailgate.

15. The vehicle of claim 14, wherein the processor processes the images captured with the imaging device and compares the images of the object to known objects and classifies the detected object based on the comparison.

16. The vehicle of claim 14, wherein the sensor further comprises one or more of an ultrasonic sensor, radar and Lidar.

17. The vehicle of claim 11, wherein the controller controls the actuator to limit movement of the powered tailgate from moving to the open position based on a first classified object being detected and allows the powered tailgate to move to the open position based on a second classified object being detected.

18. The vehicle of claim 17, wherein the controller controls speed of the actuation of the powered tailgate based on the classified type of object.

19. A method of controlling a powered tailgate on a vehicle, the method comprising:

sensing with a sensor an object in a swing path of the powered tailgate;

processing signals output from the sensor and identifying the object and classifying the object; and controlling an actuator to move the powered tailgate between the open and closed positions based on the classified object.

20. The method of claim 19, wherein the controller further ranks the object and actuates the actuator based on a ranking.

* * * * *